United States Patent [19]

Rogers

[11] 4,452,334

[45] Jun. 5, 1984

[54] TUNABLE DAMPER FOR AN ACOUSTIC WAVE GUIDE

[75] Inventor: Samuel C. Rogers, Knoxville, Tenn.

[73] Assignee: The United States of America as represented by the United States Department of Energy, Washington, D.C.

[21] Appl. No.: 435,797

[22] Filed: Oct. 21, 1982

[51] Int. Cl.[3] ..... G10K 11/00

[52] U.S. Cl. ..... 181/175; 181/207

[58] Field of Search ..... 181/206, 207, 175, 256; 333/81 B, 209, 239

[56] References Cited

U.S. PATENT DOCUMENTS 2,514,170 7/1950 Walter et al. ..... 181/207 X 4,337,843 7/1982 Wendel ..... 181/175

OTHER PUBLICATIONS

"High Temperature, High Pressure Water Level Sensor", G. N. Miller et al., IEEE Ultrasonic Symposium Proceedings, vol. 2, Cat. #80CH1602-2, pp. 877–881, Nov. 1980.

"Ultrasonic Level, Temperature, and Density Sensor", S. C. Rogers et al., IEEE Transactions on Nuclear Science, vol. NS-29, No. 1, pp. 665–668, Feb. 1982.

*Primary Examiner*—Benjamin R. Fuller

*Attorney, Agent, or Firm*—David E. Breeden; Stephen D. Hamel

[57] ABSTRACT

A damper for tunably damping acoustic waves in an ultrasonic waveguide is provided which may be used in a hostile environment such as a nuclear reactor. The area of the waveguide, which may be a selected size metal rod in which acoustic waves are to be damped, is wrapped, or surrounded, by a mass of stainless steel wool. The wool wrapped portion is then sandwiched between tuning plates, which may also be stainless steel, by means of clamping screws which may be adjusted to change the clamping force of the sandwiched assembly along the waveguide section. The plates are preformed along their length in a sinusoidally bent pattern with a period approximately equal to the acoustic wavelength which is to be damped. The bent pattern of the opposing plates are in phase along their length relative to their sinusoidal patterns so that as the clamping screws are tightened a bending stress is applied to the waveguide at 180° intervals along the damping section to oppose the acoustic wave motions in the waveguide and provide good coupling of the wool to the guide. The damper is tuned by selectively tightening the clamping screws while monitoring the amplitude of the acoustic waves launched in the waveguide. It may be selectively tuned to damp particular acoustic wave modes (torsional or extensional, for example) and/or frequencies while allowing others to pass unattenuated.

5 Claims, 4 Drawing Figures

TUNABLE DAMPER FOR AN ACOUSTIC WAVE GUIDE

BACKGROUND OF THE INVENTION

This invention relates generally to the art of acoustic dampers and more specifically, to a tunable acoustic damper which may be adapted for use in a hostile environment, such as a liquid-cooled nuclear reactor core. It is a result of a contract with the United States Department of Energy.

Reference is made to U.S. patent application Ser. No. 314,916, filed Oct. 26, 1981 for "Ultrasonic Liquid Level Detector for Varying Temperature and Pressure Environments" by Richard L. Anderson et al and having a common assignee with the present invention. The referenced ultrasonic sensor was developed to measure the coolant level in the core of a pressurized water reactor vessel in order to monitor directly the core coolant level.

In the ultrasonic level sensor, a transducer launches torsional and extensional mode ultrasonic waves into a solid rod-like stainless steel waveguide from one end of the guide which extends above the liquid coolant containment vessel. A section of magnetostrictive material is provided as part of the waveguide to allow a pair of magnetic coils surrounding this section to launch and sense echoes from the waveguide sensor portion which extends below the coolant level. The transducers are excited in an alternating sequence to interrogate the sensor with both torsional ultrasonic waves and extensional ultrasonic waves. The measured torsional wave transit time (echo) is a function of the density, level, and temperature of the fluid surrounding the waveguide. The measured extensional wave transit time is a function of the temperature of the waveguide only. The sensor may be divided into zones by the introduction of reflecting surfaces at measured intervals along its length. Consequently, the echo from each reflecting surface can be analyzed to yield a temperature profile and a density profile along the length of the sensor from which the liquid level may be determined.

When the ultrasonic waves are launched into the waveguide, they propagate in both directions along the waveguide. The waves traveling in the back-length portion of the waveguide cannot be distinguished from echoes of interest returning from the sensing end of the waveguide without special considerations. In the original level sensor design, these undesirable back-end echoes were dealt with by utilizing a long back-length region and providing electronic sensing which only received echo pulses within predetermined time windows for echo pulse discrimination. This procedure was found to be unacceptable and complicated the design of a sensor for reactor applications.

Thus, there is a need for an acoustic damper which will remove acoustic wave energy that enters the back-length section of the acoustic sensor and allow a much shorter back-length region. Conventional damper materials such as silicon rubber coating compounds, fiberglass insulation, etc., which have been used for dampers in acoustic devices would not withstand a hostile environment, such as that of a nuclear reactor.

SUMMARY OF THE INVENTION

In view of the above need, it is an object of this invention to provide an acoustic damper for use with an acoustic waveguide which will withstand a hostile environment.

Another object of this invention is to provide an acoustic damper for an acoustic waveguide which is tunable to selectively damp differing acoustic wave transmission modes and/or frequencies.

Other objects and many of the attendant advantages of the present invention will be obvious to those skilled in the art from the following detailed description of a preferred embodiment of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, the acoustic damper for an acoustic waveguide according to the present invention may comprise a metal wool surrounding an area of the acoustic waveguide in which acoustic signals are to be damped. The wool which surrounds the waveguide is sandwiched between a pair of metal plates which are formed with a sinusoidally bent pattern along their length. The bent pattern has a period approximately equal to the wavelength of the acoustic signal to be damped. A means, such as clamping screws, is provided to urge the plates toward each other to compress the wool against the waveguide so that the waveguide is subjected to alternately opposing lateral bending stresses at 180° intervals along its length in the area to be damped.

The plates and the wool may be formed of stainless steel for use in a hostile environment, such as a nuclear reactor.

Clamping screws for compressing the sandwiched assembly may be selectively tightened to tune the damper until there is an impedance match between the damper and the waveguide to provide efficient transmission of the acoustic energy to be damped into the damper area. The damper may be selectively tuned by varying the clamping force to damp particular wave modes and/or frequencies.

BRIEF DESCRIPTION OF THE DRAWINGS

The accompanying drawings, which are incorporated in and form a part of the specification, together with the description, serve to explain the principles of the invention. In the drawings.

DETAILED DESCRIPTION

Figure 1:
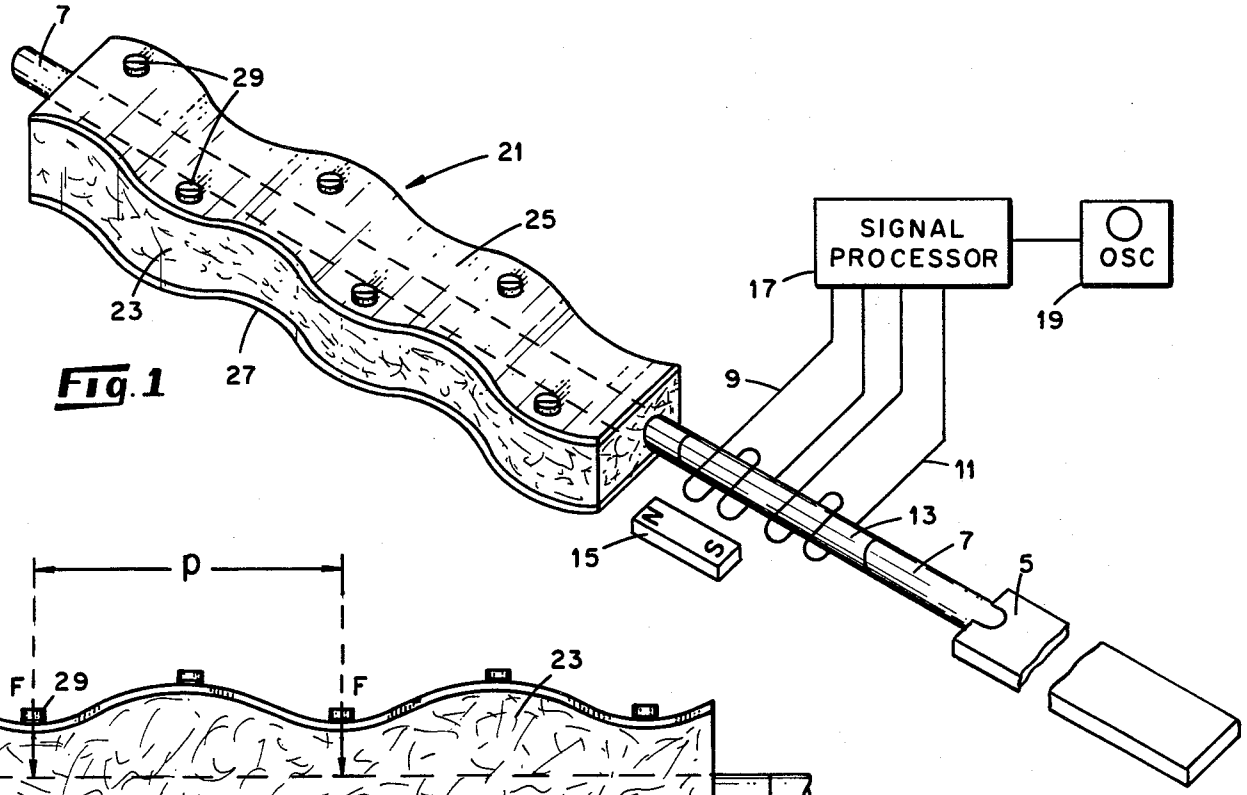
FIG. 1 is an isometric view of a damper made in accordance with the present invention coupled to the back-length portion of an ultrasonic waveguide for use as a liquid level detector.

Referring now to FIG. 1, an ultrasonic liquid level detector for use in a PWR vessel includes a sensor end portion 5 which is rectangular in cross section. The sensor portion is attached to a circular waveguide 7 which extends the waveguide for signal insertion and detection outside the reactor pressure vessel. The sensor portion 5 may be mounted within a perforated protection shield (not shown) which extends into the reactor core cooling liquid medium. The shield may be sized to fit within an instrument opening provided in the core of a PWR and a seal (not shown) is used to seal the vessel opening through which the waveguide extends. Further details of the level sensor design and operation, which are not pertinent to this application, may be had by referring to the above-referenced U.S. patent application.

Either extensional or torsional mode acoustic waves are launched into the waveguide through the extension portion 7 by means of transducers, such as electromagnetic coils 9 and 11, respectively, that surround a magnetostrictive segment 13 of the extension rod 7.

The coils 9 and 11 are mounted about 10 centimeters apart along the magnetostrictive segment 13 so that each coil can be biased and alternately driven to maximize the energy in each of the modes. The extensional and torsional mode acoustic waves are launched in the sensor by means of the well-known Joule and Wiedemann effects, respectively. The Joule effect, or longitudinal magnetostriction, produces a longitudinal extension in a magnetostrictive rod when a pulse is applied to a coil surrounding the rod which produces a magnetic field parallel to the rod. The Wiedemann effect, or torsional magnetostriction, produces a torsional stress pulse in a magnetostrictive rod when a pulse is applied to a coil surrounding the rod which opposes a circumferential magnetic field surrounding the rod, as produced by a dc current flowing through the rod. Alternatively, since a magnetostrictive rod does contain magnet material, the rod may be intially conditioned to produce the circumferential magnetic field by polarizing the rod before assembly. A large dc current typically (100 to 300 amps) is passed through the magnetostrictive segment 13 prior to its assembly to produce the proper polarization in the segment. Thus, the torsional wave may be launched directly by pulsing the coil 11.

However, to produce the extensional wave, the circumferential magnetic field produced by the pre-polarization of the segment 13 must be cancelled so that the required magnetic field parallel to the segment is produced to launch the extensional wave. This is accomplished by placing a permanent magnet 15 adjacent the coil 9 aligned to cancel the effects of the circumferential field in the area of the coil 9. Obviously, other transducers and methods of launching the extensional and torsional mode waves into the sensor with the proper timing may be employed. The timing of the alternate launching and subsequent reception of the echoes is controlled by a signal processor 17 connected to coils 9 and 11. The detected echoes may be displayed on an oscilloscope 19 connected to the output of the signal processor. The scope signal may also be used when tuning the damper 21 attached to the back-length of the waveguide extension 7 as will be described hereinbelow.

Figure 2:
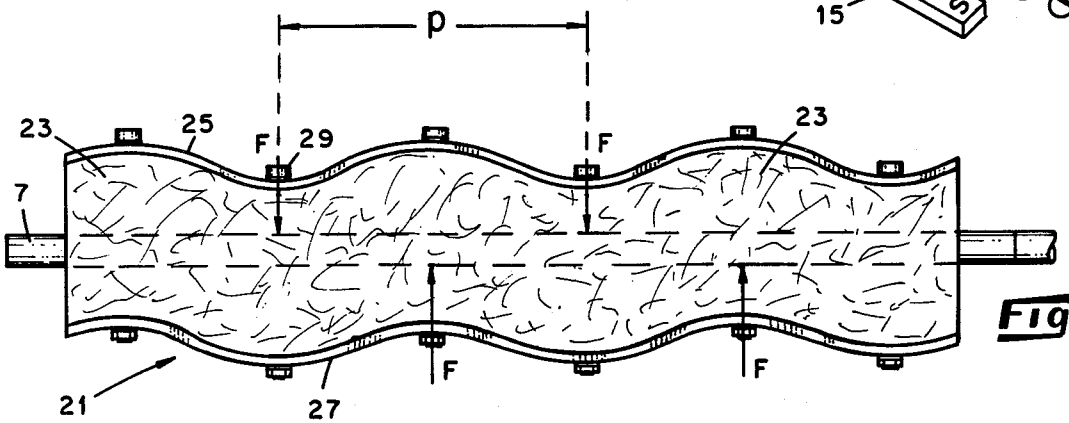
FIG. 2 is a front elevation view of the damper of FIG. 1 partially broken away to show the arrangement of the components.

Referring now to FIGS. 1 and 2, the damper 21 made in accordance with the present invention includes a mass of metal wool 23, such as stainless steel wool for reactor applications, disposed to surround the acoustic waveguide 7 in the area to be damped. The stainless steel wool is sandwiched between two rigid stainless steel plates 25 and 27. Assembly bolts 29 positioned along the length of the plates on alternating sides of the waveguide 7 hold the damper in assembly on the waveguide and are selectively tightened to tune the damper by comprising the stainless steel wool against the waveguide. The damper is tuned to obtain an impedance match between the damper and the waveguide, allowing all of the acoustic wave energy to pass into the damper. High internal absorption losses due to the inhomogeneous nature of the steel wool coupled with bending stresses placed on the waveguide provided by the shape of the plates 25 and 27 causes the acoustic waves to be completely attenuated.

The plates 25 and 27 are bent along their length according to a sinusoidal bending pattern have a period approximately equal to the wavelength ($\lambda$) of the acoustic waves being damped. Although a sine wave pattern is illustrated here, other generally sinusoidal patterns which provide the proper forces may be employed. The bent pattern of the lower plate 27 is oriented in phase with the upper plate 25 pattern, as shown in FIG. 2. This provides alternating lateral bending stresses in the waveguide 7 at 180° intervals due to the force points, as shown in FIG. 2 by arrows F, produced by the closer points of the plates to the waveguide when the steel wool is compressed. These forces tend to bend the waveguide to oppose the sinusoidal movement imposed on the guide by the acoustic wave energy traveling through the damper area.

Although the bent pattern was designed to have a period approximating that of the acoustic waves being damped, this is not critical. The bent pattern also creates a pinching effect, and provides better coupling of the steel wool to the waveguide. Damping occurs mainly because of this coupling; the proper amount of coupling results in an impedance match, which allows the energy of the acoustic wave in the guide to enter the wool where it is dispersed.

Figure 3:
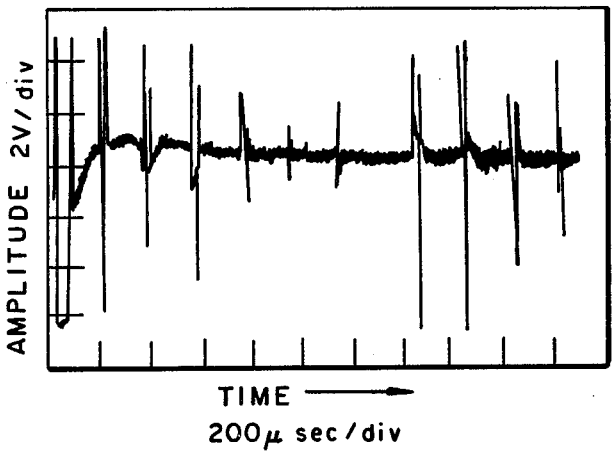
FIG. 3 is an oscilloscope plot of the response of the device of FIG. 1 without the damper installed.
Figure 4:
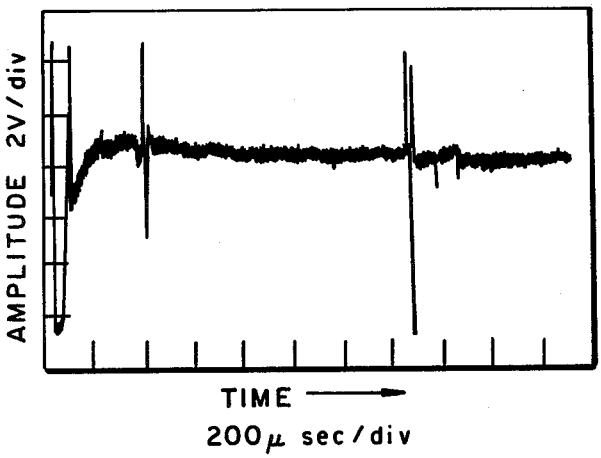
FIG. 4 is an oscilloscope plot of the same device of FIG. 3 with the damper installed and properly turned to damp torsional mode pulses traversing the back-length portion of the waveguide. It should be noted that only the echo pulses of interest from the sensing end of the waveguide are present in the plot.

To tune the damper the bolts 29 are uniformly tightened while acoustic waves are launched into the waveguide and the oscilloscope trace is observed. When the damper is properly tuned the scope trace will only show the echoes from the sensor end of the waveguide. FIG. 3 shows an example of a torsional mode pulse train that includes end reflections for a waveguide as shown in FIG. 1 without the damper installed. FIG. 4 is the same signal with all of the echoes, except those of interest from the sensor end (the transition echoes and the end echo), removed by the damper. In each plot the launched wave signal is displayed at the beginning of the plot.

Laboratory tests made on a 1/16" diameter steel rod waveguide have shown that the damper may be tuned to completely eliminate torsional mode acoustic signals. In the test, the damper plates 25 and 27 were 1/16" thick stainless steel plates ½" wide by 8" in length. The bending pattern period (p) was about 1" for an acoustic wave signal having a wavelength ($\lambda$)=1.2". The bent pattern amplitude was about ¼" peak-to-peak. The thickness of the steel wool mass surrounding the waveguide between the assembly plates prior to compression was about 1".

By further tuning the damper extensional mode signals may be attenuated about 95% which is adequate in most cases. Additional coupling is needed between the wool and the waveguide because the extensional-mode waves have a higher impedance than that of the torsional-mode waves. Therefore, further tuning, in this case, corresponds to further tightening of the compression screws.

When tuned for one mode, the other mode is largely unaffected. The damper can thus be used as a mode selectable filter for acoustic wave propagation in acoustic waveguides. With careful consideration given to waveguide material and geometry, and frequency of operation, a waveguide may be constructed and frequency chosen in which 2 modes of acoustic waves (such as extensional and torsional) have approximately the same characteristic impedance. In this special case, the damper may be tuned to eliminate both modes simultaneously.

Since the damper may be constructed from all stainless steel parts, it is easily adapted for use in highly corrosive atmospheres. When used with an ultrasonic level detector in a reactor, the damper reduces the back-length of the sensor by at least a factor of two which makes the sensor more desirable for current reactor designs. The electronic echo pulse sensing circuitry may be greatly simplified in the level detector application by using the damper to eliminate all of the spurious echoes which originally complicated the echo pulse sensing circuitry. The time between interrogation pulses launched into the waveguide is substantially reduced due to the elimination of reverberating echoes by the damper. This will allow higher repetition rates to be employed, thus increasing the dynamic response of the instrument to changes in process variables. The instrument will respond faster to process changes, which increases the bandwidth of the process signals which may be measured.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An acoustic damper for an acoustic waveguide comprising:

a mass of metal wool surrounding an area of said waveguide in which acoustic signals are to be damped;

first and second metal plates disposed over said wool along the axis of said waveguide in said area to be damped on opposite sides of said waveguide forming a sandwiched assembly with said wool surrounding said waveguide, each of said plates having a generally sinusoidally bent pattern along their length the period of which is approximately equal to the wavelength of the acoustic signal to be damped and oriented in an in-phase relationship along their length; and means for selectively urging said plates toward each other to compress said wool against said waveguide so that said waveguide is subjected to alternating opposing lateral bending stresses at 180° intervals along its length in said area in which said acoustic signals are to be damped.

2. The damper of claim 1 wherein said bent pattern of said first and second plates is a sine wave.

3. The damper of claim 1 wherein said damping means includes a plurality of assembly bolts extending through said sandwiched assembly at equal intervals along and on alternating sides of said waveguide so that said plurality of bolts may be selectively tightened to tune said damper.

4. The damper of claim 3 wherein the mass of metal wool surrounding said waveguide has a thickness prior to being compressed of about $\frac{3}{4}$ to 1".

5. The damper of claim 4 wherein said metal wool, said first and second plates and said plurality of assembly bolts are formed of stainless steel.

* * * * *